United States Patent [19]

Nishikawa et al.

[11] Patent Number: 4,515,557

[45] Date of Patent: May 7, 1985

[54] KEROSENE COMBUSTION APPARATUS

[75] Inventors: Hideo Nishikawa; Kenzo Okamoto; Koichi Sakai; Fumihiko Kitada, all of Osaka, Japan

[73] Assignee: Imanishi Kinzoku Kogyo Kabushiki Kaisha (Imarflex Mfg. Co.), Osaka, Japan

[21] Appl. No.: 572,192

[22] Filed: Jan. 19, 1984

[51] Int. Cl.[3] ..... F23D 3/02

[52] U.S. Cl. ..... 431/302; 126/96

[58] Field of Search ..... 126/96, 97; 431/302–309

[56] References Cited

U.S. PATENT DOCUMENTS 4,465,457 8/1984 Ishikawa et al. ..... 431/309

*Primary Examiner*—Carroll B. Dority, Jr.

*Attorney, Agent, or Firm*—McCormick, Paulding & Huber

[57] ABSTRACT

Kerosene combustion apparatus of a type having a vertically movable wick disposed between coaxial outer and inner cylinders, the outer cylinder being provided with slits formed at the edges of the projections whereby complete and quick extinction of flame may be achieved with considerably reduced odor.

9 Claims, 3 Drawing Figures

KEROSENE COMBUSTION APPARATUS

The invention relates to an improvement in kerosene combustion means with a vertically movable wick.

A conventional kerosene combustion means with a vertically movable wick required relatively a long time from when an action for extinquishing flame is taken until the flame has been completely put out. This resulted in generation of rather too offensive an odor. That it takes much time to completely extinguish the flame in the combustion means has been a problem to be solved as a matter of urgency in view of a great danger that may be thereby caused at a time of disaster. Among various attempts that have been made to solve the problem, apertures, for instance, were formed in the upper portion of the cylinder surrounding the wick. While producing some effects against said problem, however, this particular attempt created another disadvantages due to those very apertures. Thus no satisfactory measures have been provided to eliminate said drawback.

The object of the present invention is to provide kerosene combustion means that has completely obviated the above problem without producing secondary undesirable effects.

Kerosene combustion means according to the invention comprises outer and inner cylinders which locate a wick material between them, said outer cylinder being provided with strip-like projections extending circumferentially in the vicinity of its upper end, each of said projections having a slit at its upper or lower edge.

The invention will now be described in detail with reference to the attached drawings in which.

Figure 2:
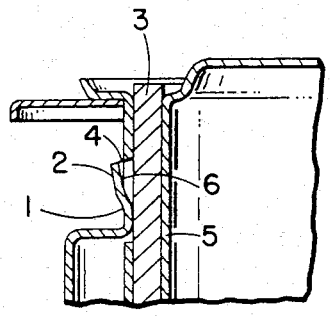
FIG. 2 is a fragmentary cross section in line A—A on FIG. 1.

An outer cylinder 1 and an inner cylinder 5 are coaxially provided with a gap between them. A wick material is fitted in said gap and adapted to be moved vertically. The outer cylinder 1 has in the vicinity of its upper end numerous strip-like projections 2 extending circumferentially at almost equal space intervals. Each of these projections 2 has a slit 4 at its upper edge as shown in FIG. 2.

When the wick material 3 is raised above the projections 2 for combustion, small spaces 6 are formed between the projections 2 and the wick material 3. The spaces 6 communicate with the atmosphere by slits 4 only.

Figure 1:
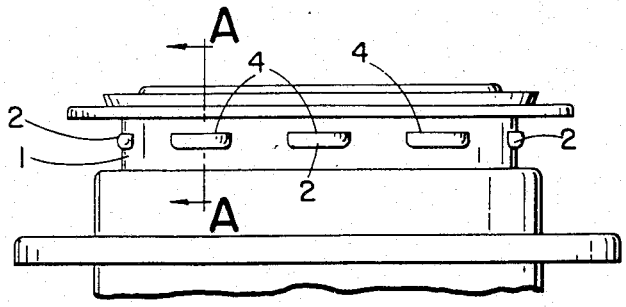
FIG. 1 is a fragmentary elevation of kerosene combustion means according to the invention.

While according to the embodiment shown in FIG. 1, the projections 2 are provided along a single circumferential line at equal intervals, the projections may be provided along two upper and lower lines in alternate order. Alternatively, an annular projection may be provided, in which case the slits 4 are intermittently formed in the annular projection. In any case, the total length of the slits provided is preferably a third to second of the whole circumference of the outer cylinder.

The total area of the projections may be properly determined based on the size of the cylinders, the areas of the slits and the like.

While in the embodiment shown in FIG. 2, the slits 4 are formed at the upper edge of the projections 2, they may be formed at the lower edge thereof. Alternatively, the slits 4 may be formed in either upper or lower edge of the projections in alternate order.

The slits 4 need not have the same circumferential length as the projections 2. The projections may have a longer length than the slits.

Owing to the construction described above, when the wick material is lowered for extinction of flame and the upper end of the wick material passes by the projections 2, air is rapidly admitted inside through the slits 4 due to the somewhat negative pressure created right above the upper end of the wick material. The air thus admitted cools the wick material 3 at the spaces 6 formed inside the projections 2 and prevents vaporisation of the kerosene efficiently and quickly so that the flame does not remain long in the inflaming portion of the wick material. Also the air in the spaces 6, urged by the inflow of air from outside immediately drives away the petroleum vapor lingering right above the upper end of the wick material. Thus immediate extinction of flame is achieved the moment the wick material 3 passes by the projections.

Figure 3:
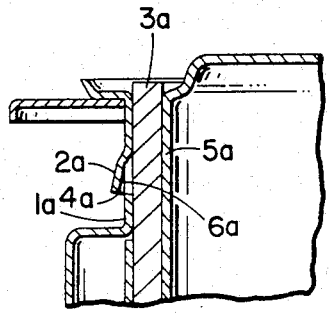
FIG. 3 is a fragmentary view of another embodiment similar to FIG. 2.

When the wick material 3 is raised to stop the projections, there are formed, as mentioned above, small spaces 6 between the wick material 3 and the atmosphere. Since these small spaces communicate with the atmosphere by only the slits 4, air is little exchanged between these spaces and the atmosphere. In other words, the wick material 3 is not in direct contact with the atmosphere. Thus there is no possibility of kerosene vapor flowing out of the slits and burning outside the combustion means as could occur in the conventional devices.

Where the slits 4*a* are formed at the lower edge of the projections as shown in FIG. 3, air exchange between the spaces 6*a* and the atmosphere is further reduced whereas the upper end of the wick material may be prevented from being caught at the edge of the projections when the wick is raised and developing splits. However, the basic effects produced according to the invention are the same whether the slits are formed at the upper or lower edge of the projections.

Enlargement of the area of the slits 4, where desired, is preferably made by elongating the circumferential lengths of the slits rather than widening their widths.

Thus the invention has made it possible to achieve quick and complete extinction of flame by means of a simple structure with much less odor. In addition, the kerosene combustion means according to the invention is totally free from the danger of generating external flame.

We claim:

1. Kerosene combustion apparatus of a type in which ignition, extinction and control of caloric power are effected by vertically moving a wick material comprising:

inner and outer cylinders coaxially disposed relative to one another and defining a gap therebetween; a wick material disposed within the gap between the cylinders, the outer cylinder being provided in the vicinity of its upper end with outwardly strip-shaped projections extending circumferentially, each having a slit.

2. Kerosene combustion apparatus of claim 1, wherein the projections are provided at equal space intervals in a circumferential direction.

3. Kerosene combustion apparatus of claim 1, wherein the projections are disposed along upper and lower circumferential lines in alternate order.

4. Kerosene combustion apparatus of claim 1, wherein the projections are annular projection.

5. Kerosene combustion apparatus of claim 1 wherein the slits are formed at the upper edge of the projection.

6. Kerosene combustion apparatus of claim 1 wherein the slits are formed at the lower edge of the projection.

7. Kerosene combustion apparatus of claim 1, wherein the slits are formed at the upper and lower edges of the projections in alternate order.

8. Kerosene combustion apparatus of claim 3, wherein the upper projections are provided with slits at the lower edges thereof and the lower projections are provided with slits at the upper edges thereof.

9. Kerosene combustion apparatus of claim 4, wherein the annular projection is provided with slits at its upper and lower edges alternately and intermittently.

* * * * *